United States Patent [19]

Hiro et al.

[11] Patent Number: 4,863,823

[45] Date of Patent: Sep. 5, 1989

[54] ELECTROPHOTOGRAPHIC MEMBER WITH THE SURFACE LAYER HAVING A FLUORINE TYPE RESIN POWDER AND A FLUORINE TYPE BLOCK POLYMER

[75] Inventors: Masaaki Hiro, Kanagawa; Tomohiro Kimura, Yokohama; Toshiyuki Yoshihara, Mitaka; Yoichi Kawamorita; Masaru Nakagawa, both of Yokohama, all of Japan

[73] Assignee: Canon Kabushiki Kaisha, Tokyo, Japan

[21] Appl. No.: 177,349

[22] Filed: Apr. 1, 1988

[30] Foreign Application Priority Data

Apr. 6, 1987 [JP] Japan ..... 62-082979

[51] Int. Cl.[4] ..... G03G 5/14

[52] U.S. Cl. ..... 430/58; 430/66; 430/67

[58] Field of Search ..... 430/58, 59, 66, 67

[56] References Cited

U.S. PATENT DOCUMENTS 3,859,090 1/1975 Yoerger et al. ..... 430/66 X
4,663,259 5/1987 Fujimura et al. ..... 430/58

FOREIGN PATENT DOCUMENTS 62-206559 9/1987 Japan ..... 430/66

*Primary Examiner*—Roland E. Martin
*Assistant Examiner*—Jeffrey A. Lindeman

[57] ABSTRACT

An electrophotographic photosensitive member has a photosensitive layer on an electroconductive support, characterized in that the surface layer contains a fluorine type resin powder and a fluorine type block copolymer.

16 Claims, No Drawings

ELECTROPHOTOGRAPHIC MEMBER WITH THE SURFACE LAYER HAVING A FLUORINE TYPE RESIN POWDER AND A FLUORINE TYPE BLOCK POLYMER

BACKGROUND OF THE INVENTION

1. Field of the Invention

This invention relates to an electrophotographic photosensitive member which can be utilized widely for electrophotographic field of application. More particularly, it pertains to a highly durable electrophotograhic photosensitive member excellent in humidity resistance and mechanical strength.

2. Related Background Art

An electrophotographic photosensitive member is required to have necessary sensitivity, electrical characteristics, optical characteristics corresponding to the electrophotographic process to be applied, and further in a photosensitive member which is to be used repeatedly, since the surface layer of the photosensitive member, namely the layer the remotest from the substrate, is applied directly with electrical, mechanical external force such as by corona charging, toner development, transfer to paper, cleaning treatment, etc., durability to those is required.

Specifically, durability to generation of abrasion or damage on the surface by sliding, or deterioration of the surface by ozone generated during corona charging, etc. has been demanded.

On the other hand, there is also a problem of toner attachment onto the surface layer by repeated development of toner and cleaning, and to cope with this problem, improvement of the cleaning characteristic of the surface layer has been demanded.

Various methods have been investigated in order to satisfy the characteristics required for the surface layer as described above, and among them the means of dispersing fluorine type resin powder in the surface layer is effective, as disclosed in Japanese Laid-open Patent Applications Nos 25749/1981, 126836/1981, 74748/1982 or USP 4663259. By dispersion of fluorine type resin powder, frictional coefficient of the surface layer is lowered to act on improvement of cleaning characteristic, improvement of durability to abrasion resistance, etc.

Such means is also effective for prevention of surface deterioration under humid conditions, since water repellency and mold releasability can be also improved.

However, in the fluorine type resin powder dispersion, there is a problem involved in its dispersibility and agglomerating characteristic. That is, since a uniform and smooth film can be formed with difficulty, the surface layer obtained cannot avoid inevitably having image defects such as image irregularity, pinhole, etc.

Although some of binding materials resins or dispersing aids can disperse fluorine type resin powder uniformly to form a smooth film, in most cases, they have hydroxyl groups, carboxyl groups, ether bonds, etc., and therefore deterioration of electrophotographic characteristics will be caused by carrier trap under high temperature and high humidity conditions, whereby no practically applicable one can be found under the present situation.

In contrast, the present Applicant has previously found in Japanese Patent Applications Nos. 58253/1986 and 54096/1987 that an electrophotographic photosensitive member having the surface layer comprising fluorine type resin powder dispersed in the presence of a fluorine type graft polymer can respond to the requirements as mentioned above.

However, a fluorine type graft polymer requires a large number of reaction steps in synthesis. The present Applicant has reached the present invention as the result of investigation of a dispersing aid which can be synthesized according to simpler method and can exhibit an effect equal to or better than that as described above.

SUMMARY OF THE INVENTION

Thus, an object of the present invention is to provide an electrophotographic photosensitive member having durability to generation of abrasion or damage of the surface by sliding.

Another object of the present invention is to provide an electrophotographic photosensitive member which can obtain stable and high quality images even under high humidity.

A further object of the present invention is to provide an electrophotographic photosensitive member having good cleaning characteristic without attachment of toner onto the surface layer.

Still another object of the present invention is to provide an electrophotographic photosensitive member which can obtain constantly images of high quality without coating irregularity or pinhole on the surface, and also without accumulation of residual potential in repeated electrophotographic process.

A still further object of the present invention is to provide an electrophotographc photosensitive member by use of a dispersing aid which can be synthesized according to a simple method.

The present inventors have investigated according to the above objects, and consequently found that an electrophotographic photosensitive member having a surface layer containing a fluorine type resin dispersed in the presence of a fluorine type block polymer can respond to the demands as mentioned above to accomplish the present invention.

More specifically, the present invention is constituted of an electrophotographic photosensitive member having a photosensitive layer on an electroconductive support, characterized in that the surface layer contains a fluorine type resin powder and a fluorine type block copolymer.

DETAILED DESCRIPTION OF THE PREFERRED EMBODIMENTS

For the fluorine type resin powder to be applied for the present invention, one or more may be suitably selected from among tetrafluorethylene resin, trifluorochloroethylene resin, tetrafluorethylene-hexafluoropropylene resin, vinyl fluoride resin, vinylidene fluoride resin, difluorodichloroethylene resin and copolymers thereof, but particularly preferably one of a low molecular weight grade and with a primary particle size of 1 μm or less.

The content of the fluorine type resin powder dispersed in the surface layer may be appropriately 1 to 50% by weight, particularly preferably 2 to 30% by weight, based on the weight of the solid components in the surface layer. With a content less than 1% by weight, the surface layer improvement effect by the fluorine type resin power is not sufficient, while at a level exceeding 50% by weight, light transmittance is lowered and also mobility of carriers is lowered.

The fluorine type block polymer to be used in the present invention is a block copolymer of a fluorine containing monomer and a non-fluorine monomer, with arrangement of the fluorine containing monomer and the non-fluorine monomer being connected to each other in the molecule to form a relatively long single molecular chain. Such fluorine type block polymer is used as the surface improving material for the surface layer of an electrophotographic photosensitive member, as disclosed in Japanese Laidopen Patent Application No. 116362/1986. In the present invention, by using such florine type block polymer as the dispersing aid for the fluorine type resin powder, the fluorine resin type powder is uniformly dispersed to improve its dispersion stability.

More specifically, in a fluorine type block polymer, fluorine type segments and non-fluorine type segments are respectively localized, thus having the separated function form such that the fluorine type segments are oriented to the fluorine type resin powder and the non-fluorine type segments to the resin layer added, respectively. Particularly, since the fluorine type segments are arranged continuously, fluorine type segments can be absorbed at high density and with good efficiency to the fluorine type resin powder, and further since the non-fluorine type segments are oriented to the resin layer, the dispersion stabilizing effect of the fluorine type resin powder not found in the dispersing aid of the prior art can be exhibited. Also, while fluorine type resin powder generally exists as agglomerated body on the order of several μm, by use of the fluorine type block polymer as the dispersing aid, uniform dispersion can be effected to primary particles of 1 μm or less.

The proportion of the fluorine type segments in the fluorine type block polymer may be preferably 5 to 70% by weight, more preferably 10 to 50% by weight.

If the proportion of the fluorine type segments is less than 5% by weight, the dispersion stabilizing function of the fluorine type resin powder cannot be exhibited fully, while it exceeds 70% by weight, compatibility with the surface layer resin added will become poor.

The amount of the fluorine type block polymer added may be appropriately 0.1 to 30%, particularly preferably 1 to 20%, by weight based on the fluorine type resin powder.

If the amount added is less than 0.1% by weight, the effect of the dispersion stabilizing effect of the fluorine type resin powder is not sufficient, while if it exceeds 30%, the fluorine type block polymer will be present as existing in the free state on the surface layer or internally of the resin layer other than absorbed on the fluorine type resin powder, whereby accumulation of residual potential will occur when electrophotographic process is performed repeatedly.

The fluorine type block polymer to be used in the present invention can be prepared according to the methods as described below.

(i) The method in which a polymer having a radical generating group at a molecular terminal is synthesized and a block of different kind of monomer is grown from this terminal.

For example, by polymerization of styrene (St) with tetramethylthiuram disulfite as the initiator, a polystyrene as shown below can be obtained.

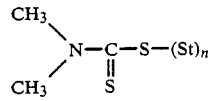

By growing by polymerization a fluorine containing monomer, a fluorine type block can be obtained. Also, a polymer obtained by photopolymerization of styrene with the use of trichlorobromethane as the chain transfer agent will generate radicals as follows by UV-ray.

$$Cl_3C(St)_nBr \xrightarrow{UV} Cl_3C(St)_n\cdot + Br\cdot$$

Accordingly, by use of the polystyrene as the photosensitizer, a fluorine containing monomer can be photopolymerized to give a fluorine type block polymer.

(ii) The method in which a different kind of monomer is polymerized to the active terminal of a polymer under growth. In the case of radical polymerization, there is the method in which a watersoluble monomer and an oil-soluble monomer are emulsion polymerized and, while under growth reaction, led to a different kind of monomer by flowing down a capillary. On the other hand, for a monomer capable of forming a living polymer, in the case of anion, monomers may be added successively. Also, a combination of both cation and anion living polymers is possible. The method by use of a living polymer is very useful as the synthetic method of a model compound in varying monodispersibility or block length freely.

(iii) The method in which a polymer having a functional group such as hydroxyl group, carboxylic group at the terminal is synthesized, and two kinds of such polymers are coupled with a bifunctional compound.

Preferable examples of fluorine containing monomers are shown below, but the scope of available compounds is not limited to the scope as mentioned here.

Compound No. (1)-(18)

$CH_2{=}CHF$ (1)

$CH_2{=}CF_2$ (2)

$CHF{=}CF_2$ (3)

$CF_2{=}CF_2$ (4)

$CF_2{=}CFCl$ (5)

$CF_2{=}CFCF_3$ (6)

$CF_2{=}CF{-}R_f$ (7)

$CF_2{=}CF{-}O{-}R_f$ (8)

$CH_2{=}CH{-}R_f$ (9)

$CH_2{=}CH{-}O{-}R_f$ (10)

$CH_2{=}C(R_1){-}C(=O){-}OR_f$ (11)

$CH_2{=}C(R_1){-}C(=O){-}N(H){-}R_f$ (12)

-continued

Compound No. (1)-(18)

(13)

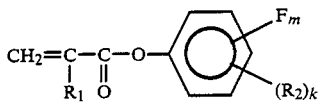

(14)

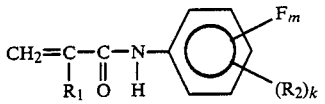

(15)

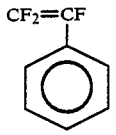

(16)

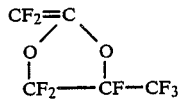

(17)

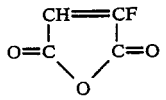

(18)

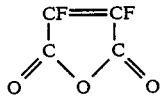

In the above compounds, $R_1$ represents hydrogen atom, halogen atom or methyl group. $R_2$ represents hydrogen atom, halogen atom, alkyl group, alkoxy group or nitrile group, and may be a combination of several kinds thereof, k is an integer of 1 to 4, m an integer of 1 to 5 and $k+m=5$. $R_f$ represents alkyl group substituted with at least one fluorine atom.

As the non-fluorine type monomer, at least one of low molecular weight straight chain unsaturated hydrocarbons, vinyl halides, vinyl esters of organic acids, vinyl aromatic compounds, acrylic and methacrylic acid esters, N-vinyl compounds, vinylsilicon compounds, esters of maleic anhydride, maleic acid and fumaric acid, etc. may be available, but it is necessary to select one compatible with the resin layer of the surface layer in which the fluorine type block polymer formed is added or, if not completely compatible, one having similar structure with affinity, even if little, existing between the both.

For example, when the surface layer resin layer is a poly(meta)acrylic acid ester, also as the non-fluorine type monomer, a meta(acrylic) acid ester is preferable, while in the case of polystyrene or polycarbonate, a styrene type compound should be preferably selected.

The binding material resin for forming the surface layer may be a polymer having film forming property, but polymethacrylate, polystyrene, methacrylate/styrene copolymer, polycarbonate, polyarylate, polyester, polysulfone, etc. are preferred from such points that it should have hardness to some extent and will not interfere with carrier transport.

In preparing the electrophotographic photosensitive member of the present invention, as the electroconductive support, there may be employed metals such as aluminum, stainless steel, etc., cylinders or films having electroconductive layers comprising electroconductive particles dispersed in appropriate binding material resin provided on supports such as plastics. However, when the support itself is electroconductive, the electroconductive support is not required to have an electroconductive layer provided thereon.

On these electroconductive supports, a subbing layer (adhesive layer) having the barrier function and the subbing function can be provided.

The subbing layer is provided for the purpose of improving adhesiveness of the photosensitive layer, improving coatability, protecting the electroconductive support, covering the defect on the electrocoductive support, improving the charge injectability from the electroconductive support and protecting the photosensitive layer against electrical destruction. As the material for the subbing layer, there have been known polyvinyl alcohol, poly-N-vinylimidazole, polyethyleneoxide, ethyl cellulose, methyl cellulose, ethylene-acrylic acid copolmer, casein, polyamide, copolymer nylon, glue, gelatin, etc.

These are coated on a support as solutions dissolved in solvents suited respectively therefor. The film thickness may be about 0.2 to 2 μm.

As the charge generating substance, there can be employed cyanine type dyes, azulene type dyes, squvarilium type dyes, pyrylium type dyes, thiapyrilium type dyes, phthalocyanin type pigments, anthanthrone type pigments, dibenzpyrenequinone type pigments, pyranthrone type pigments, azo type dyes such as monoazo pigments, disazo pigments, trisazo pigments, etc., indigo type pigments, quinacridone type pigments, asymmetric quinocyanine, quinocyanine, etc.

As the charge transporting substance, organic photoconductive materials are preferred, and examples thereof may include pyrene, N-ethylcarbazole, N-isopropylcarbazole, N-methyl-N-phenylhydrazine-3-methylidene-9-ethylcarbazole, N,N-diphenylhydrazine-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenyl-hydrazino-3-methylidenee-10-ethylphenoxazine, hydrazones such as p-diethylaminobenzaldehyde-N,N-diphenyl-hydrazone, p-diethylaminobenzaldehyde-N-α-naphthyll-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, etc., 2, 5-bis(p-diethylaminophenyl)-1,3-4-oxadiazole, pyrazolines such as 1-phenyl-3-(p-diethylaminostyryl)-5-(p-diethylaminophenyl)pyrazoline, 1-[quinolyl (2)]-3-(p-diethylaminostyryl)-5-(p-diethylaminophenyl)pyrazoline, 1-[pyridyl (2)]-3-(p-diethylaminostyryl)5-(p-diethylaminophenyl)-pyrazoline, 1-[6-methoxypyridyl (2)]-3-(p-diethylminostyryl)-5-(p-diethylaminophenyl)pyrazoline, 1-[pyridyl (3)]-3-(p-diethylaminostyryl)-5-(p-diethylaminophenyl)pyrazoline, 1-[lepidyl (2)]-3-(p-diethylaminostyryl)-5-(p-diethylaminophenyl)pyrazoline, 1-[pyridyl 2)]-3-(p-diethylaminostyryl)-4-methyl-5-(p-diethylaminophenyl)pyrazoline, 1-[pyridyl (2)]-3-(α-methyl-p-diethylaminostyryl)-5-(p-diethylaminophenyl)-pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline, etc., oxazole type compounds such as 2-(p-diethylaminostyryl)-6-diethylaminobenzoxazole, 2-(p-diethylaminopheneyl)-4-(p-dimethylaminophenyl)-5-(2-chlorophenyl)oxazole, etc., thiazole type compounds such as 2-(p-diethylaminostyryl)-6-diethylaminobenzthiazole, etc. triarylmethane type compounds such as bis (4-diethylamino-2-methylphenyl)phenylmethane, etc., polyarylalkanes such as 1,1-bis (4-N,N-diethylamino-2-methylphenyl)-heptane, 1,1,2,2-tetrakis(4-N,N-dimethylamino-2-methylphenyl)ethane, etc., stilbene compounds such as 5-(4-diphenylaminobenzylidene)-5H-dibenzo[a,d]cycloheptene, 1,2-benzo-3-(d-phenylstyryl)-9-n-butylcarbazole, etc.

The method for preparing the electrophotographic photosensitive member of the present invention is described by referring to an example of the case of the function separation type photosensitive member having a charge transport layer laminated on a charge generation layer.

The above charge generating substance is well dispersed together with 0.3 to 10-fold amount of a binding material resin and a solvent by such means as homogenizer, sonication, ball mill, vibrating ball mill, sand mill, attritor, roll mill, etc. This dispersion is applied on the support coated with the above subbing layer and dried to form a coating of about 0.1 to 1 μm.

In this Example, since the surface layer becomes the charge transport layer, fluorine type resin powder is dispersed therein.

That is, a binder resin, a fluorine type resin powder, a fluorine type block polymer are dispersed together with a solvent by means of a homogenizer, sonication, sand mill, attritor ball mill, etc., and a solution of a charge transporting substance and a binder resin is added to make up a desired charge transport layer solution.

The fluorine type block polymer has the greatest effect in contributing to stability of the fluorine type resin powder when added during dispersing the fluorine type resin powder. However, it is also possible that the fluorine type resin powder may be previously dispersed, and then the fluorine type block polymer may be added.

The mixing ratio of the charge transporting substance to the binding material resin may be about 2:1 to 1:4.

As the solvent, aromatic hydrocarbons such as toluene, xylene, etc., chlorinated hydrocarbons such as dichloromethane, chlorobenzene, chloroform, carbon tetrachloride, etc. can be used. During coating of this solution, for example, the methods such as dip coating, spray coating, spinner coating, bead coating, blade coating, curtain coating, etc. can be used, and drying can be effected at a temperature ranging from 10° to 200° C., preferably from 20° to 150° C., for 5 minutes to 5 hours, preferably for 10 minutes to 2 hours under air stream drying or under stationary drying. The charge transport layer formed has a film thickness of about 10 to 30 μm.

In the case of a photosensitive member having a charge transport layer provided by coating of a charge generation layer, the charge generation layer becomes the surface layer and therefore the fluorine type resin powder stabilized in dispersion with the fluorine type block polymer is contained therein. The charge generation layer dispersion can be prepared according to the method in which a dispersion containing the fluorine type resin powder dispersed as the dispersing aid in the binding material resin used as the charge generation layer is added and mixed into the dispersion of the charge generating substance as prepared above, and a photosensitive member of the present invention can be obtained by coating the dispersion onto the charge transport layer.

When the photosensitive layer is the single layer type containing a charge generating substance and a charge transporting substance, the single layer type photosensitive layer becomes the surface layer, and the fluorine type powder stabilized in dispersion with the fluorine type block polymer is contained in the photosensitive layer.

When the photosensitive layer has a protective layer, the protective layer becomes the surface layer of the photosensitive layer, and the fluorine type resin powder stabilized in dispersion with the fluorine type block polymer is contained in the protective layer. The protective layer can be obtained by coating a dispersion of the fluorine type resin powder stabilized in dispersion with the fluorine type block polymer in the resin forming thee protective layer onto the photosensitive layer.

The present invention is described in more detail by referring to Examples.

EXAMPLE 1

An aluminum cylinder of 80ϕ×300 mm was used as the substrate. This was coated with a 5% methanolic solution of a polyamide resin (trade name: Amilan CM-8000, produced by Toray) according to the dipping method to provide a subbing layer with a thickness of 1 μm thereon.

Next, 10 parts (by weight, hereinafter the same) of a disazo pigment having the following formula:

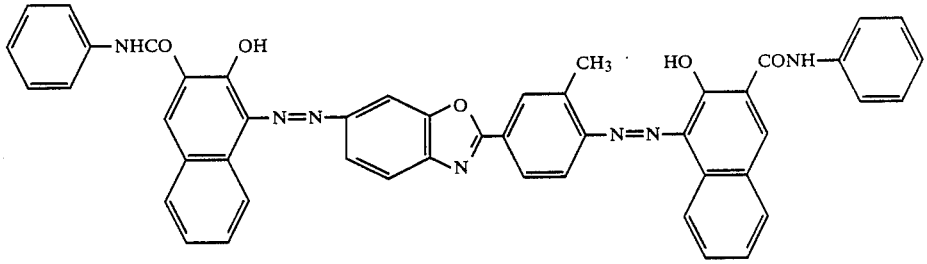

8 parts of a polyvinyl butyral resin (trade name: S-LEC BXL, produced by Sekisui Kagaku K.K.) and 50 parts of cyclohexanone were dispesed by means of a sand mill device by use of 1 ϕ glass beads. To this dispersion was added 70 to 120 (q.s.) parts of methyl ethyl ketone, and the resultant mixture was applied on the subbing layer to form a charge generation layer with a film thickness of 0.15 μm.

Next, 10 parts of a polystyrene (trade name: HF-55, produced by Mitsubishi Monsanto K.K.), 10 parts of a polytetrafloroethylene (average particle size 0.4 μm, molecular weight about 10,000) and 0.5 part of a fluorine type block polymer synthesized from the above fluorine atom containing polymerizable monomer No. 4 fluoracrylate (a mixture of $R_1$=H, n=8, 10, 12, 14) (fluoroacrylate/styrene weight ratio=2/8, block polymer with molecular weight Mw:$4.5\times10^4$ obtained by photopolymerization of styrene with the use of trichlorobromomethane as the chain transfer agent, followed further by copolymerization of fluoroacrylate) were dissolved in 70 parts of cyclohehxanone and dispersed in a stainless steel ball mill for 50 hours. With 10 parts of the dispersion obtained were mixed 10 parts of a hydrozone compound of the formula:

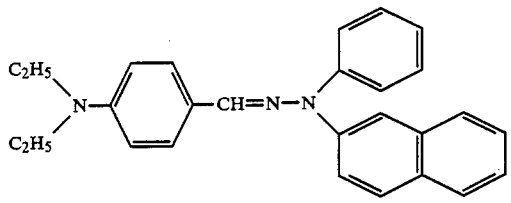

and 70 parts of a resin solution containing 10 parts of a polystyrene (HF-55, produced by Mitsubishi-Monsanto) dissolved in 60 parts of cyclohexanone to prepare a charge transport solution. The average particle size of the polytetrafluoroethylene powder in the charge transport solution was found to be 0.41 μm by a particle size distribution measuring machine (CAPA-500, produced by Horiba Saisakusho).

This solution was applied on the above charge generation layer and dried in hot air at 110° C. for 90 minutes to form a charge transport layer with a thickness of 18 μm. This is called Sample 1.

The surface of Sample 1 was uniform and smooth, with the average surface roughness of the surface layer being 0.2 μm, which was equal to the average surface roughness of the charge transport surface formed from the charge transporting material containing no fluorine type resin powder and the binding material resin. For comparison, the same sample as described above except for adding no fluorine type block copolymer was prepared. This is called Sample 2.

In Sample 2, polytetrafluoroethylene powder in the surface layer was excessively agglomerated to give a state which was of no value for image evaluation.

On the other hand, the same sample as described above was prepared except for adding no polytetrafluorethylene and fluorine type block polymer. This is called Sample 3.

For these samples, evaluation of successive copying for 10,000 sheets was conducted according to electrophotographic process, comprising corona charging at -5.5 kv, image exposure, developing by dry system toner, toner transfer onto plain paper and cleaning with a urethane rubber blade. The results are shown in Table 1.

TABLE 1

| | Initial image | Successive copying at 23° C. 55% RH | Successive copying at 32.5° C. 90% RH |
|---|---|---|---|
| Sample 1 | Good | High quality and stable images up to 10000 sheets | High quality and stable images up to 10000 sheets |
| Sample 2 | Excessive coarsening | Not worthwhile successive copying | Not worthwhile successive copying |
| Sample 3 | Good | Sliding flaw appeared after 2000 sheets | Image flow after 2000 sheets |

EXAMPLE 2

Block polymers of the above fluorine atom containing polymerizable monomer No. 1 fluoromethacrylate (R1:$CH_3$), No. 2 fluoroacrylamide ($R_1$:H), No. 4 fluoromethacrylaminde (R:$CH_3$, mixture of n=8, 10, 12, 14), No. 5 tetrafluorophenyl metacrylate ($R_1$:$CH_3$, $R_2$:H, m=4) and No. 6 tetrafluorocyanophenylacrylamide ($R_1$:H, $R_2$:CN, m=4) respectively with styrene (styrene 70% by weight) were synthesized according to the same method as in example 1. The respective samples are called a, b, c, d and e.

By use of these block polymers, charge transport layer solutions were prepared in the same manner as in Example 1. The average particle sizes of polytetrafluoroethylene powder in these charge transport layer solutions were 0.40, 0.45, 0.41, 0.48 and 0.50 μm, respectively. Next, photosensitive members were prepared in the same manner as in Example 1.

These are called Samples 4–8, which had all surface roughness of 0.2 μm or less. When successive copying evaluation was performed similarly as in Example 1 for these Samples, images of high quality were obtained stably up to successive copying of 10,000 sheets.

EXAMPLE 3

With the use of an aluminum cylinder of 80ϕ×300 mm, a 5% methanolic solution of a polyamide resin (trade name: Amilan CM-8000, produced by Toray) was applied thereon according to the dipping method to provide a subbing layer with a thickness of 1 μm.

Next, 12 parts of a pyrazoline compound having the following formula:

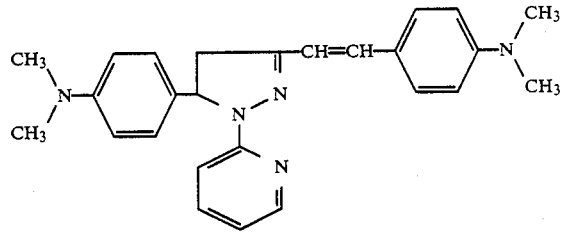

and 10 parts of a polycarbonate resin (IUPILON S-2000, produced by Mitsubishi Gas Kagaku) in 60 parts of dichloroethane. This solution was applied by dipping on the above subbing layer and dried at 100 ° C. for 1 hour to form a charge transport layer with a thickness of 14 μm.

Next, 10 parts of a bisazo pigment of the following formula:

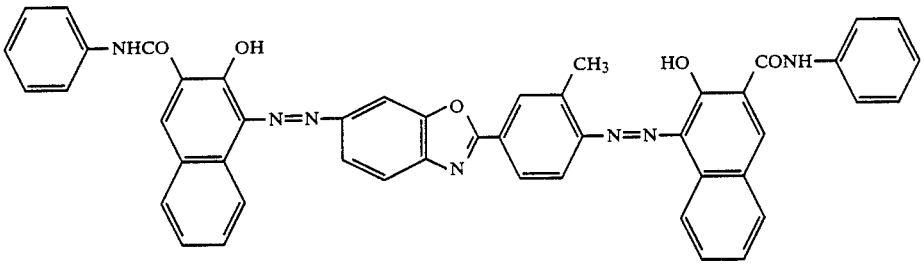

5 parts of a polyvinylidene fluoride with an average particle size of 0.5 μm and a molecular weight of about 100,000 and 0.3 part of the fluorine type block polymer of Example 1 wer dissolved in 100 parts of dichloroethane, and the mixture was dispersed in a stainless ball mill for 50 hours. The polyvinylidene fluoride powder in this dispersion had an average particle size of 0.52 μm.

The solution was thrust coated onto the charge transport layer and dried at 100 ° C. for 20 minutes to form a charge generation layer with a thickness of 2 μm. This is called Sample 9. The surface roughness was found to be 0.2 μm or less. For comparison, samples with no addition of fluorine type block polymer and polyvinylidene fluoride were prepared. These are called Sample 10 and Sample 11.

The samples thus obtained were mounted on an electrophotographic copying machine having the steps of +5.6 kv corona charging, image exposure, dry system toner developing, toner transfer onto plain paper, cleaning with a urethane rubber blade, etc. to carry out successive copying test for 10,000 sheets. The results are shown in Table 2.

TABLE 2

| | Initial image | Successive copying at 23° C. 55% RH | Successive copying at 32.5° C. 90% RH |
|---|---|---|---|
| Sample 9 | Good | High quality and stable images up to 10000 sheets | High quality and stable images up to 10000 sheets |
| Sample 10 | Excessive coarsening | Not worthwhile successive copying | Not worthwhile successive copying |
| Sample 11 | Good | Sliding flaw appeared after 1500 sheets | Image flow after 1200 sheets |

EXAMPLE 4

With the use of an aluminum cylinder of 80ϕ×300 mm, a 5% methanolic solution of a polyamide resin (trade name: Amilan CM-8000, produced by Toray) was applied thereon according to the dipping method to provide a subbing layer with a thickness of 1 μm.

Next, 1 part of an aluminum chloride phthalocyanine (produced by Toyo Ink) and 10 parts of a polycarbonate resin (IUPILON S-3000, produced by Mitsubishi Gas Kagaku), 4 parts of a polytrifluorochloroethylene (average particle size 0.5, molecular weight about 100,000) and 0.2 part of the fluorine type block polymr of Example 2 were dissolved and mixed in 40 parts of dichloroethane and 10 parts of THF, dispersed in a stainless ball mill for 50 hours, followed further by adition and dissolution of 6 parts of the hydrazone compound of Example 1 to prepare a photosensitive solution.

The average particle size of the polytrifluorochloroethylene powder in this dispersion was found to be 0.54 μm.

This solution was applied by dipping on the above subbing layer and dried at 100 ° C. for 60 minutes to provide a photosensitive layer with a thickness of 12 μm. This is called Sample 12.

The surface roughness was 0.2 μm or less.

For comparison, a sample with addition of no polytrifluorochloroethylene and fluorine type block polymer was prepared similarly. This is called Sample 13.

The samples thus obtained were mounted on an electrophotographic copying machine having the steps of +5.6 kv corona charging, image exposure, dry sytem toner developing, toner ransfer onto plain paper, cleaning with a urethane rubber blade, etc. to carry out successive copying test for 5,000 sheets. The results are shown in Table 3.

TABLE 3

| | Successive coyping at 23° C. 55% RH | Successive copying at 32.5° C. 90% RH |
|---|---|---|
| Sample 12 | High quality and stable images up to 5000 sheets | High quality and stable images up to 5000 sheets |
| Sample 13 | Sliding flaw and toner fusion occurred after 1000 sheets | Image flow occurred after 2000 sheets |

EXAMPLE 5

By use of the polystyrene, the polytetrafluoroethylene and the fluorine type block polymer used in Example 1, a polytetrafluoroethylene dispersion was obtained in the same manner as in Example 1. The dispersion was thrust coated onto the surface layer of Sample 3 prepared in Example 1 and dried in hot air at 100 ° C. for 30 minutes to form a protective layer with a thickness of 3 μm. This is called Sample 14. The surface roughness was 0.2 μm or less. When this sample was subjected to the successive copying test for 10,000 sheets in the same manner as in Example 1, high quality and stable images could be obtained up to 10,000 sheets under both conditions of 23° C., 55% R.H. and 32.5 ° C., 90%.

We claim:

1. An electrophotographic photosensitive member having a photosensitive layer on an electroconductive support, characterized in that the surface layer contains a binder, a fluorine type resin powder and a fluorine type block copolymer.

2. An electrophotographic photosensitive member according to claim 1, wherein said fluorine resin powder is selected from the group consisting of tetrafluorethylene resin, trifluorochloroethylene resin, terafluoroethylene-hexafluoropropylene resin, vinyl fluoride resin, vinylidene fluoride resin, difluorodichloroethylene resin and copolymers thereof.

3. An electrophotographic photosensitive member according to claim 1, wherein the fluorine type block copolymer is constituted of fluorine containing segments derived from a fluorine containing monomer and non-fluorine type segments derived from a nonfluorine monomer.

4. An electrophotographic photosensitive member according to claim 3, wherein said fluorine containing monomer is selected from the group consisting of a fluorine-substituted low molecular weight straight chain unsaturated hydrocarbon, fluorine-substituted vinyl halide, fluorine-substituted vinyl ester of organic acid, fluorine-substituted alkyl vinyl ether, fluorine-substituted alkyl ester and amide of acrylic acid and methacrylic acid, fluoine-substituted aromatic containing ester and amide of acrylic acid and methacrylic acid, fluorinated maleic acid anhydride, fluorine-substituted alkyl ester of malic acid and fumaric acid, $\alpha$-luorinated styrene, $\alpha,\beta,\beta$-fluorinated styrene.

5. An electrophotographic photosensitive member according to claim 3, wherein the fluorine block segments constituting said fluorine type block polymer comprise 5 to 70% by weight of the block polymer.

6. An electrophotographic photosensitive member according to claim 1, wherein the content of said fluorine type resin powder is 1 to 50% of the surface constituting components in terms of weight ratio.

7. An electrophotographic photosensitive member according to claim 1, wherein the amount of said fluorine type block polymer is 0.1 to 30% by weight based on the fluorine type resin powder.

8. An electrophotographic photosensitive member according to claim 1, wherein said photosensitive layer has a laminated structure of a charge generation layer and a charge transport layer, and the charge transport layer is laminated on the charge generation layer.

9. An electrophotographic photosensitive member according to claim 1, wherein said photosensitive layer has a laminated structure of a charge generation layer and a charge transport layer, and the charge generation layer is laminated on the charge transport layer.

10. An electrophotographic photosensitive member according to claim 1, wherein said photosensitive layer comprises a single layer containing a charge generating substance and a charge transporting sustance.

11. An electrophotographic photosensitive member according to claim 1, wherein said photosensitive layer has a protective layer as the surface layer.

12. An electrophotographic photosensitive member according to any of claims 8, 9, 10 and 11, wherein the charge transporting substance contained in the photosensitive layer is an organic photoconductive material.

13. An electrophotographic photosensitive member according to any of claims 8, 9, 10 and 11, wherein the charge transporting substance contained in the photosensitive layer is selected from the group consisting of hydrozone type compounds, pyrazoline type compounds, oxazole type compounds, thiazole type compounds, triarylmethane type compounds, polyarylalkane type compounds, stilbene type compounds.

14. An electrophotographic photosensitive member according to any of claims 8, 9, 10 and 11, wherein the charge generating substance contained in the photosensitive layer is an organic photoconductive material.

15. An electrophotographic photosensitive member according to any of claims 8, 9, 10 and 11, wherein the charge generating substance contained in the photosensitive layer is a pigment or a dye.

16. An electrophotographic photosensitive member according to any of claims 8, 9, 10 and 11, wherein the charge generating substance contained in the photosensitive layer is an azo pigment or a phthalocyanine pigment.

* * * * *

UNITED STATES PATENT AND TRADEMARK OFFICE

CERTIFICATE OF CORRECTION

PATENT NO. : 4,863,823

DATED : September 5, 1989

INVENTOR(S) : MASAAKI HIRO, ET AL.

It is certified that error appears in the above-identified patent and that said Letters Patent is hereby corrected as shown below:

ON TITLE PAGE:

IN [56] REFERENCES CITED

Insert --Attorney, Agent, or Firm--Fitzpatrick, Cella, Harper & Scinto--.

COLUMN 1

Line 12, "electrophotograhic" should read --electrophotographic--.
Line 42, "USP 4663259." should read --U.S. Pat. No. 4,663,259.--.
Line 61, "carrier trap" should read --carriers trapped--.

COLUMN 2

Line 33, "electrophotographc" should read --electrophotographic--.

COLUMN 3

Line 12, "Laidopen" should read --Laid-open--.
Line 43, "while it" should read --while if it--.

COLUMN 4

Line 10, "trichlorobromethane" should read --trichlorobromoethane--.
Line 23, "watersoluble" should read --water-soluble--.

UNITED STATES PATENT AND TRADEMARK OFFICE

CERTIFICATE OF CORRECTION

PATENT NO. : 4,863,823

DATED : September 5, 1989

INVENTOR(S) : MASAAKI HIRO, ET AL.

It is certified that error appears in the above-identified patent and that said Letters Patent is hereby corrected as shown below:

COLUMN 5

Line 54, "poly(meta)acrylic" should read --poly(meth)acrylic--.
Line 55, "meta(acrylic)" should read --meth(acrylic)--.

COLUMN 6

Line 20, "copolmer," should read --copolymer,--.
Line 27, "squvarilium" should read --squarilium--.
Line 28, "phthalocyanin" should read --phthalocyanine--.
Line 37, "N-methyl-N-phenylhydrazine-3-" should read --N-methyl-N-phenylhydrazino-3- --.
Line 38, "N,N-diphenylhydrazine-" should read --N,N-diphenylhydrazino- --.
Line 40, "-9-ethylcarbazole," should read -- -10-ethylphenothiazine,--.
Line 41, "-10-ethylphenothia-" should read -- -10-ethylphenoxa- --.
Line 42, "N,N-diphenyl-hydrazino-3-methylidenee-10-" should be deleted.
Line 43, "ethylphenoxazine," should be deleted.
Line 45, "-naphthyll-" should read -- -naphthyl- --.
Line 55, "(p-diethylaminostyryl)5-" should read --(p-diethylaminostyryl)-5- --.
Line 56, "1-[6-methoxypyridyl(2)]-3-(p-diethylminos-" should read --1-[6-methoxy-pyridyl(2)]-3-(p-diethylaminos- --.

UNITED STATES PATENT AND TRADEMARK OFFICE

CERTIFICATE OF CORRECTION

PATENT NO. : 4,863,823

DATED : September 5, 1989

INVENTOR(S) : MASAAKI HIRO, ET AL.

It is certified that error appears in the above-identified patent and that said Letters Patent is hereby corrected as shown below:

COLUMN 7

Line 1, "2-(p-diethylaminopheneyl)-4-" should read --2-(p-diethylaminophenyl)-4- --.
Line 4, "etc." should read --etc.,--.

COLUMN 8

Line 31, "thee" should read --the--.
Line 60, "dispesed" should read --dispersed--.
Line 68, "polytetrafloroethylene" should read --polytetrafluoroethylene--.

COLUMN 9

Line 11, "cyclohehxanone" should read --cyclohexanone--.
Line 14, "hydrozone" should read --hydrazone--.

COLUMN 10

Line 17, "(R1:$CH_3$)," should read --($R_1$:$CH_3$),--.
Line 18, "fluoromethacrylaminde" should read --fluoromethacrylamide--.
Line 19, "metacrylate" should read --methacrylate--.
Line 23, "example 1." should read --Example 1.--.

COLUMN 11

Line 17, "wer" should read --were--.
Line 60, "polymr" should read --polymer--.
Line 63, "adition" should read --addition--.

UNITED STATES PATENT AND TRADEMARK OFFICE

CERTIFICATE OF CORRECTION

PATENT NO. : 4,863,823

DATED : September 5, 1989

INVENTOR(S) : MASAAKI HIRO, ET AL.

It is certified that error appears in the above-identified patent and that said Letters Patent is hereby corrected as shown below:

COLUMN 12

Line 26, "dry sytem" should read --dry system--.
Line 27, "toner ransfer" should read --toner transfer--.
TABLE 3, "coyping" should read --copying--.
Line 65, "tera-" should read --tetra- --.

COLUMN 13

Line 16, "fluoine-substituted" should read --fluorine-substituted--.
Line 19, "malic acid" should read --maleic acid-- and "α-luorinated" should read --α-fluorinated--.

COLUMN 14

Line 21, "hydrozone" should read --hydrazone--.
Line 24, "compounds, stilbene" should read --compounds, and stilbene--.

Signed and Sealed this

Thirteenth Day of August, 1991

*Attest:*

HARRY F. MANBECK, JR.

*Attesting Officer*

*Commissioner of Patents and Trademarks*